US005718428A

United States Patent [19]

Almira

[11] Patent Number: 5,718,428

[45] Date of Patent: Feb. 17, 1998

[54] EDUCATIONAL DEVICE

[76] Inventor: Jose Leopoldo Almira, 2009 Fletcher St., #1, Houston, Tex. 77009-8005

[21] Appl. No.: 815,119

[22] Filed: Mar. 11, 1997

[51] Int. Cl.[6] ..... A63F 9/00

[52] U.S. Cl. ..... 273/272; 273/138.1; 273/138.5; 273/144 B; 273/457

[58] Field of Search ..... 273/138.1, 144 R, 273/145 R, 145 C, 144 B, 138.5, 457, 272

[56] References Cited

U.S. PATENT DOCUMENTS

| | | | |
|---|---|---|---|
| 4,509,758 | 4/1985 | Cole | 273/145 C |
| 4,533,143 | 8/1985 | Albright | 273/145 C |
| 4,936,576 | 6/1990 | Farraj | 273/457 |
| 5,022,654 | 6/1991 | Berger | 273/457 |
| 5,050,882 | 9/1991 | Yang | 273/457 |
| 5,328,173 | 7/1994 | Stern | 273/457 |

*Primary Examiner*—William M. Pierce
*Attorney, Agent, or Firm*—Bill B. Berryhill

[57] ABSTRACT

An educational device having an enclosed housing formed of a vessel-like base and a substantially flat transparent top the edges of which sealingly engage upper edges of the base. The housing is substantially filled with liquids. A divider is carried within the housing adjacent the top. The divider comprises mutually perpendicular vertical walls defining an array of bottom opening compartments which, when viewed through the top, are arrayed in mutually perpendicular rows and columns. A plurality of buoyant ball members, having distinctive indicia thereon, are carried in the housing.

9 Claims, 2 Drawing Sheets

EDUCATIONAL DEVICE

BACKGROUND OF THE INVENTION

1. Field of the Invention

The present invention pertains to educational devices. More specifically, the present invention pertains to word games by which individuals are stimulated to spell and recognize words from randomly displayed game pieces.

2. Description of the Prior Art

There a number of word game educational devices such as Scrabble, Yahtze, etc. In most of these games, a plurality of dice is provided, each die side having a single letter of the alphabet thereon. The dice are randomly distributed to each player who must then arrange the dice in some manner to spell a word. Scores are typically based on the number of words and the difficulty of spelling words with particular letters of the alphabet.

While most of the word games are certainly educational and beneficial, they are similar in appearance and do not offer an attractive or appealing appearance. In addition, most of the word game educational devices require two or more players to be interesting.

SUMMARY OF THE PRESENT INVENTION

The present invention provides an educational device which, in its preferred embodiment, resembles a watermelon split in half. It has an enclosed housing formed of an elongated semi-spheroid vessel-like base and a substantially flat transparent top the edges of which sealingly engage the elliptical edges of the base. The housing is substantially filled with liquid, e.g. red water. A divider assembly is carried within the housing adjacent the top and comprises mutually perpendicular vertical walls defining an array of bottom opening compartments or cubicles which, when viewed through the top, are arrayed in perpendicular rows and columns. A plurality of ball members, preferably black in color, are carried within the housing. Each of the balls is of a diameter slightly less than the width of the compartments and has distinctive indicia thereon. Each of said balls is also buoyant in the fluid so that if the device is inverted and returned to an upright position, each of the balls will rise in the fluid, randomly entering one of the compartments so that the indicia thereon may be viewed through the transparent top in a randomly displayed manner. In a preferred embodiment, the transparent top is formed with a plurality of bubble-like spherical segments, each one of which lies above one of the compartments so that when one of the balls rises in the fluid and enters one of the compartments it will also engage a corresponding one of the spherical segments, allowing the indicia on the ball to be viewed therethrough. In a preferred embodiment of the invention, the housing is green, the fluid is red and the balls are black so as to resemble the outside and inside of a watermelon, the balls representing seeds thereof.

The purpose of the game to be played with the educational device is to recognize words which are spelled by horizontal, vertical or diagonal alignment of the balls in their respective compartments. The indicia on the balls may be letters of the alphabet, e.g. "a to z", numbers representing letters of the alphabet, e.g. "1 to 26" or any other indicia.

The educational device of the present invention serves as a fun learning device, particularly for children. It teaches children how to form words and provides a competitive challenge thereto. Its action-oriented design alleviates boredom associated with other types of word games. The educational device of the present invention can be utilized by families at home, patients in hospitals, students in schools, etc. For example, the device can be used by individual students or numbers of students in competitive word games while the teacher monitors and observes the students ability to recognize words. There are many ways in which the educational device of the present invention can be used. Many other objects and advantages will be understood from reading the description which follows in conjunction with the accompanying drawings.

DESCRIPTION OF A PREFERRED EMBODIMENT

Figure 1:
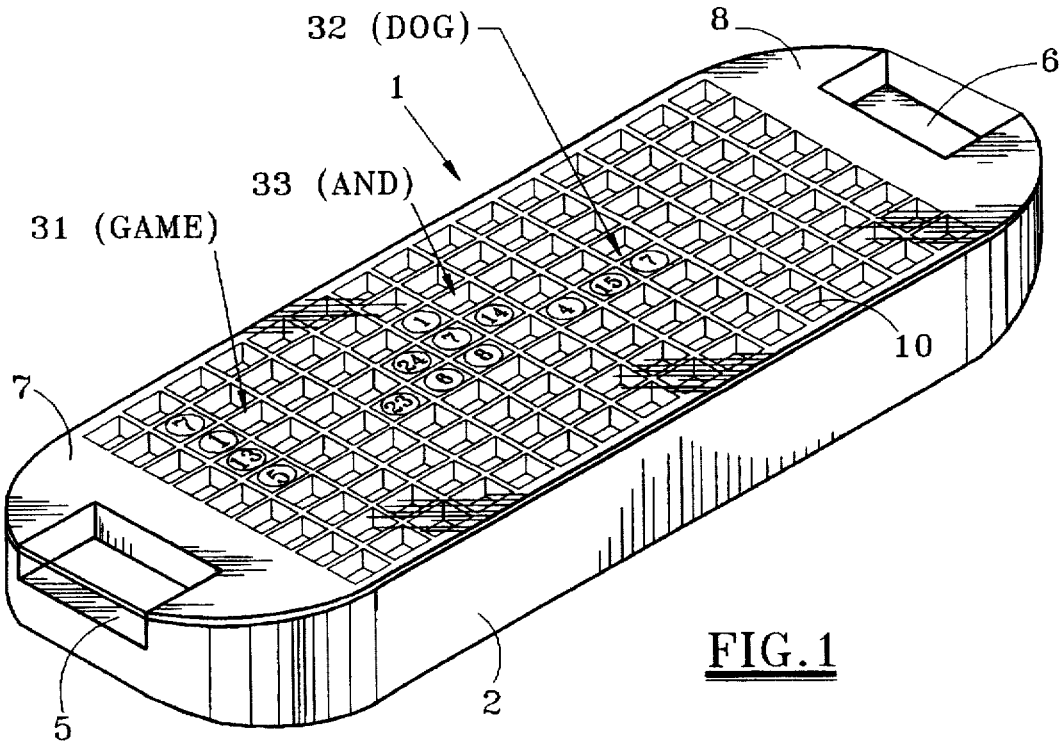
FIG. 1 is a pictorial representation of the educational device of the present invention.
Figure 2:
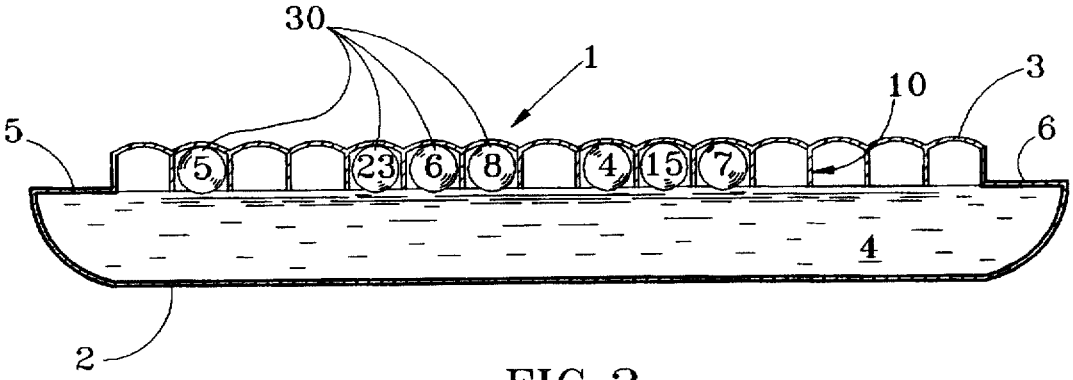
FIG. 2 is an elevation view of the educational device of the present invention, in section, according to a preferred embodiment thereof.

Referring first to FIGS. 1 and 2, there is shown an educational device 1, according to a preferred embodiment of the invention. The educational device 1 has a housing which is formed of a vessel like base 2 and a substantially flat transparent top 3. In the preferred embodiment, the base 2 is an elongated semi-spheroid resembling the outer skin of a watermelon split in half. In fact, in a preferred embodiment it would be green on the outside and white on the inside. The transparent top 3 sealingly engages the elliptical edges of the base 2. The housing formed by the base 2 and the top 3 is substantially filled with liquid, e.g. red water so as to resemble the inside of a watermelon.

The ends of the base 3 may be provided with recesses 5 and 6 for engagement by opposite hands of the person using the device 1. In addition, flat upper end surfaces 7, 8 at opposite ends of the transparent top 3 may be provided on which words advertising the game or instructions for playing the game may be printed.

Figure 5:
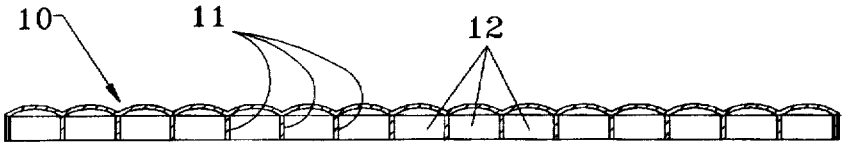
FIG. 5 is an edge view of a divider assembly for use with the educational device of FIGS. 1 and 2, according to a preferred embodiment thereof.
Figure 6:
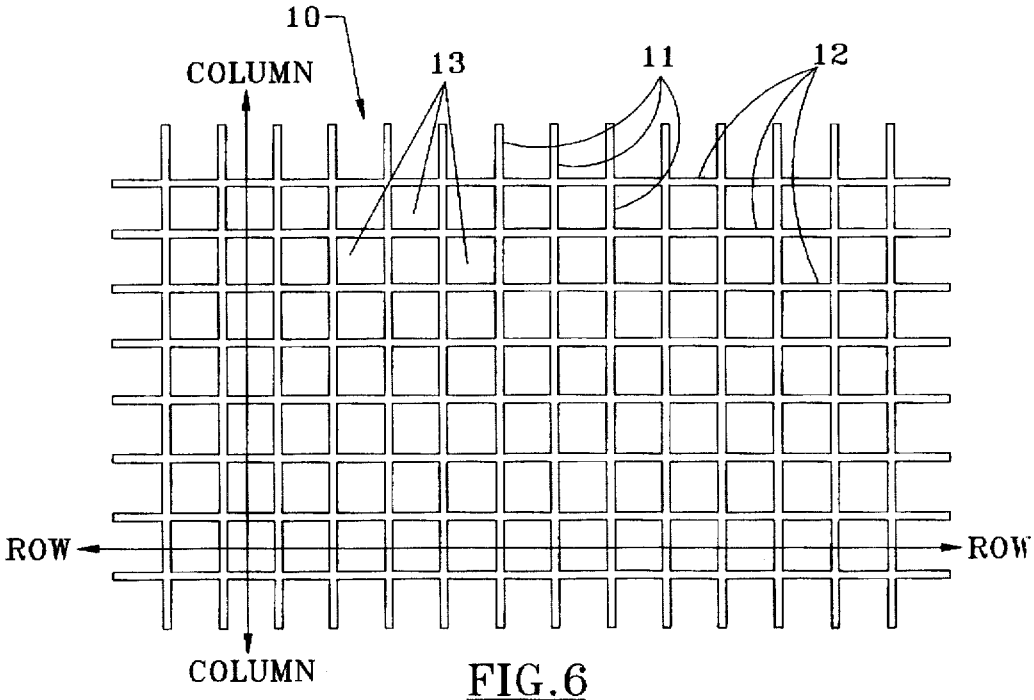
FIG. 6 is a top plan view of the divider assembly of FIG. 5.

Carried within the housing, just underneath the transparent top 3 is a divider assembly 10, shown in more detail in FIGS. 5 and 6. The divider assembly comprises mutually perpendicular vertical walls 11 and 12 which define an array of bottom opening cubicle compartments 13 which, when viewed through the top 3 are arrayed in mutually perpendicular rows and columns, one row and one column being designated as such in FIG. 6. In the preferred embodiment illustrated, there are nine rows and fifteen columns resulting in one hundred and thirty-five compartments 13.

Figure 3:
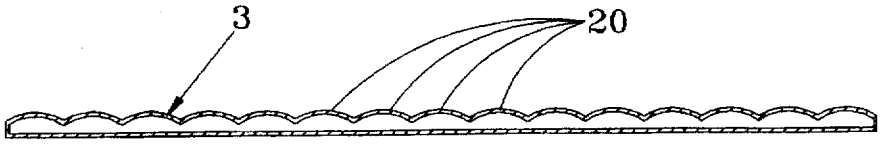
FIG. 3 is an edge view of the transparent top of the device of FIGS. 1 and 2, according to a preferred embodiment thereof.
Figure 4:
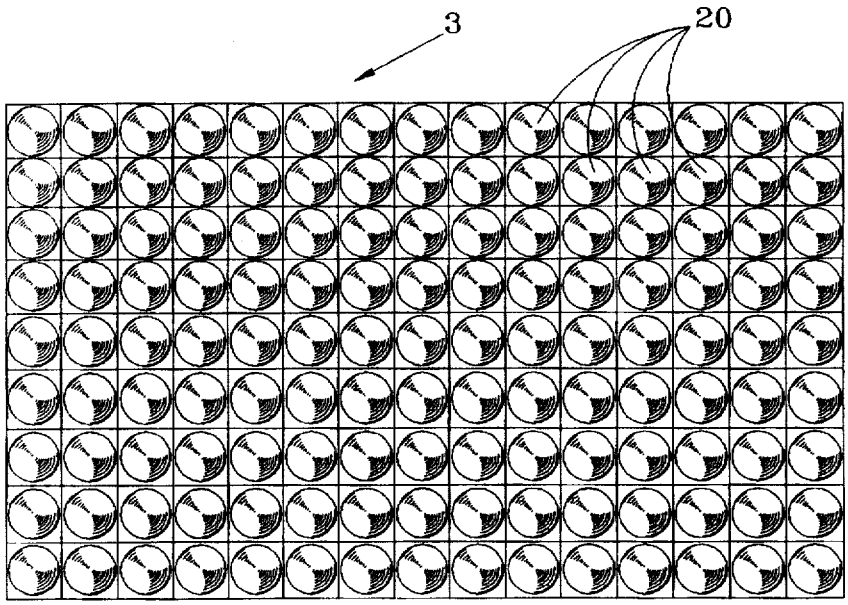
FIG. 4 is a top plan view of the transparent top of FIG. 3.

In the preferred embodiment illustrated in the drawings, the transparent top 3, as also shown in more detail in FIGS. 3 and 4, is preferably formed with a plurality of bubble-like spherical segments 20 each one of which, when properly placed, lies directly above one of the cubicle compartments 13 of the divider assembly 10. Thus, the bubble-like spherical segments 20 are also arrayed in rows and columns which correspond with the rows and columns of the divider assembly, as illustrated in FIG. 6. A plurality of ball members 30 are also carried in the housing. Each of the balls 30 is of a diameter slightly less than the width of the cubicle compartments 13 of the divider assembly 10. The balls 30 are also buoyant in the fluid (water) 4 so that the balls will rise or float to the top of the device 1 when in the upright position illustrated in FIGS. 1 and 2. Each of the ball members 30 has imprinted thereon distinctive indicia. To follow the watermelon theme, the balls may be black in color with white indicia thereon. The indicia on the balls 30 may be letters of the alphabet, numbers or any other indicia from which some form of communication may be recognized. In the challenging exemplary embodiment, the indicia consists of the numbers "1" through "26" representing the twenty-six letters of the alphabet. For example, "1" represents the letters "a", "3" represents "c", "12" represents "l", "26" represents "z", etc. In any event, the indicia would probably be printed on at least two sides of the balls 30 so that regardless of the orientation of the balls, the indicia could be seen through the transparent top 3. In the particular embodiment illustrated, there are ninety three balls, three for each letter of the alphabet (seventy-eight) and three additional for each of the five vowels of the alphabet (fifteen). Thus, there would be ninety three balls to fill corresponding compartments 30 leaving forty two compartments empty.

In use, the ends of the device would be grasped by the user, e.g., at the hand recesses 5 and 6, and the device inverted. As this occurs, the balls 30, being buoyant, would rise from the inverted top 1 within the housing toward the inverted bottom of the device. In this position the device 1 could be shaken or moved to inclined positions causing the balls 30 to be randomly distributed therein. Then the device would be returned to the upright position illustrated in FIGS. 1 and 2. As this occurs, each of the balls 30 would rise in the fluid 3 randomly entering one of the cubicle compartments 13 so that the indicia thereon may be viewed through the transparent top 3 and specifically through the bubble-like spherical segments 20 thereof. Then the user would attempt to spell words which appeared vertically, horizontally or diagonally in the resulting array. For example the word "game" 31, represented by the numbers 7, 1, 13, 5, is shown in a vertical column of FIG. 1. The word "dog" 32, represented by the numbers 4, 15, 17, is shown in a horizontal row of FIG. 1. The word "and" 33, represented by the numbers 1, 14, 4, is shown in a diagonal of FIG. 1. This action would be repeated by the user or by multiple users if being used in competitive games or learning.

Thus, the present invention provides an educational device or toy which could be universally used by persons of all ages and languages to practice and learn word skills. In the preferred embodiment it is shaped and colored to resemble a watermelon split in half so as to be attractive and fun, particularly for children.

A single embodiment of the invention has been described herein. However, many variations can be made without departing from the spirit of the invention. Accordingly, it is intended that the scope of the invention be limited only by the claims which follow.

I claim:

1. An educational device comprising:

an enclosed housing formed of a vessel-like base and a substantially flat transparent top the edges of which sealingly engage upper edges of said base, said housing being substantially filled with liquid;

divider means carried within said housing adjacent said top, said divider means comprising mutually perpendicular vertical walls defining an array of bottom opening compartments which, when viewed through said top, are arrayed in mutually perpendicular rows and columns, the upper portion of said compartments being closed by said top; and a plurality of ball members carried in said housing, each of said balls being of a diameter slightly less than the width of said compartments and having distinctive indicia thereon, each of said balls also being buoyant in said fluid so that if said device is inverted and then returned to an upright position, each of said balls will rise in said fluid, entering one of said compartments so that the indicia thereon may be viewed through said transparent top in a randomly displayed manner, said transparent top being formed with a plurality of bubble-like spherical segments, each one of which lies above one of said compartments so that any of said balls which rise in said fluid and enters one of said compartments will also engage one of said spherical segments allowing said indicia on said ball to be viewed therethrough.

2. The educational device of claim 1 in which said vessel-like base is elongated semi-spheroidal in shape and green in color, said fluid being of a reddish color and said balls being black so as to resemble the outside, inside and seeds of a watermelon, respectively.

3. The educational device of claim 1 in which there are at least twenty-six of said balls each of which is provided with a distinctive indicia representing one of the twenty-six letters of the modern alphabet.

4. The educational device of claim 3 in which there are additional balls each of which is provided with a distinctive indicia representing one of the vowels of the modern alphabet.

5. The educational device of claim 3 in which each of said balls is provided with numerical indicia, each of which represents a specific letter of said alphabet.

6. The educational device of claim 3 in which there are (1+X) 26 balls, where X=any positive integer, so that there are at least 1+X balls representing each letter of said alphabet.

7. The educational device of claim 6 in which there are Y additional balls representing each vowel of said alphabet.

8. The educational device of claim 7 in which there are total of ninety-three balls, three representing each letter of said alphabet and an additional three representing each of five vowels of the alphabet.

9. The educational device of claim 7 in which there are one hundred thirty-five of said compartments.

* * * * *